United States Patent [19]

Rhoton

[11] Patent Number: 4,509,218

[45] Date of Patent: Apr. 9, 1985

[54] DRAIN PIPES FOR EMPTYING WAVELESS WATERBED MATTRESSES

[75] Inventor: Albert L. Rhoton, Cypress, Calif.

[73] Assignee: Morgan Flotation Systems, Los Angeles, Calif.

[21] Appl. No.: 476,489

[22] Filed: Mar. 18, 1983

[51] Int. Cl.[3] ..... A47C 27/08

[52] U.S. Cl. ..... 5/450; 5/451; 137/590; 141/65; 29/401.1

[58] Field of Search ..... 5/451, 452, 422, 453, 5/454, 449, 450; 141/65; 137/590, 592

[56] References Cited

U.S. PATENT DOCUMENTS

| | | | |
|---|---|---|---|
| 2,292,876 | 8/1942 | Gladville | 137/590 |
| 3,625,365 | 12/1971 | Armstrong et al. | 210/289 |
| 3,797,538 | 3/1974 | Mollura | 5/451 |
| 3,908,690 | 9/1975 | Smotmeyer | 132/590 |
| 4,286,636 | 9/1981 | Credle | 141/65 |
| 4,411,033 | 10/1983 | Morgan | 5/450 |

*Primary Examiner*—Alexander Grosz

*Attorney, Agent, or Firm*—Blakely, Sokoloff, Taylor & Zafman

[57] ABSTRACT

A waterbed mattress system including wave dampening filler material is described which can be rapidly drained of the liquid contained therein. The invented system is provided with at least one perforated pipe which channels the liquid to the drain port. The perforated pipe and method for using the same are also described.

10 Claims, 4 Drawing Figures

DRAIN PIPES FOR EMPTYING WAVELESS WATERBED MATTRESSES

BACKGROUND OF THE INVENTION

This invention relates to apparatus and method for emptying liquid filled bladder type mattresses such as waterbed mattresses adapted to suppress undesired fluid wave motion by the inclusion of wave dampening means composed of foam, fiber or the like. More particularly, this invention relates to a system comprising elongated perforated pipes inserted into a waterbed mattress thereby increasing the rate with which such a mattress is emptied.

A number of types of waterbed mattresses and other flotation systems have been developed which have the capacity to suppress or dampen liquid wave motion. This liquid wave dampening has been achieved in some cases by the inclusion of a core of material such as fiber or foam inside the mattresses.

For example, in U.S. Pat. No. 3,585,356, issued to C. Hall discloses the use of ground, shredded, or blocks of expanded cellular styrene in a waterbed mattress to produce a wave dampening effect.

Fraige, U.S. Pat. No. 4,301,560, discloses the use of non-woven or very loosely woven expanded fiber product in a waterbed mattress to dampen wave motion.

A presently pending application by Morgan, Ser. No. 191,169, now U.S. Pat. No. 4,411,033 which has been assigned to the assignee of the present application, discloses a waterbed mattress having a slab of substantially open-celled foam or cellulosic sponge disposed in the waterbed mattress.

The use of the materials such as those described above for dampening wave motion in waterbed systems has created a difficult draining problem. Often it becomes necessary to remove the liquid from a filled mattress in order to move the waterbed or to service leaks in the mattress. A king size mattress, for example, contains about 1600 to 2000 pounds of water, depending on the degree of fill. Small units contain lesser amounts of water, although the problem of draining the mattress is still severe.

A waterbed mattress may be drained using various means such as a siphon or pump. The most common pump is the Venturi type, which may be operated on most household water spigots. A Venturi pump will drain a regular king size mattress in 40 to 50 minutes. However a king size mattress containing foam or fiber fill requires several hours to be drained using a Venturi pump and is generally still too heavy to be handled by an individual of ordinary strength. The problem of draining and moving a wave dampening material-filled waterbed has caused consumer resistance to the sale of this product.

Draining of a waterbed mattress containing wave dampening material is so slow for two principal reasons. First, the encapsulation in the interstices of the foam or fiber greatly slows the movement of the water to the drain port. Second, water flows through the drain port area faster than it flows from the wave dampening material, thereby creating a vacuum which at least partially collapses the drain port and the area around it. As a result, the drain port is sealed against further draining or, at least closed so as to restrict flow therethrough.

SUMMARY OF THE INVENTION

In accordance with the present invention, a liquid enclosure means is provided containing therein a wave dampening filler material and a liquid communicating means which facilitates the transport of liquid contained in the mattress to a drain port.

The invention provided herein is effective for the rapid draining of a waterbed mattress containing wave dampening filler material. The method of draining a liquid filled waterbed mattress and the like is also described.

More particularly, a water-tight bladder or mattress provided with a stoppered filler opening or drain port which permits the filling or draining of the mattress. Wave dampening filler material such as foam or fiber is contained in the bladder. A liquid communicating means, more particularly, at least one elongated tube or pipe with holes therein distributed along the length and around the circumference of the pipe, is disposed inside the mattress so that an open end of the pipe is positioned near the drain port. The body of the pipe extends generally horizontally into the liquid contained in the mattress, preferably lying on top of the wave dampening filler material contained therein.

The perforated pipes can be disposed in any configuration about the interior of the mattress. In one embodiment, two pipes extend from the drain port to opposite corners at the end of the waterbed mattress furthest from the drain port, thereby forming a "V". In another embodiment, four pipes, two longer ones in the same configuration as in the first embodiment, and two shorter pipes forming a wider "V" are disposed inside the mattress.

Any arrangement of perforations in the pipe would be effective so long as the holes in the pipe remain in contact with the liquid contained in the mattress. In one particular embodiment, the holes are in pairs, opposite each other, each pair of holes separate from and offset by 90 degrees from each adjacemnt pair of holes.

The method of draining a liquid filled waterbed mattress and the like comprises inserting the drain pipes into the mattress through the drain port leaving the trailing end of the drain pipe near the drain, attaching a draining means such as a siphon or pump to the drain port, and operating the drain means thereby removing the liquid contained in the mattress.

DETAILED DESCRIPTION OF THE INVENTION

Figure 1:
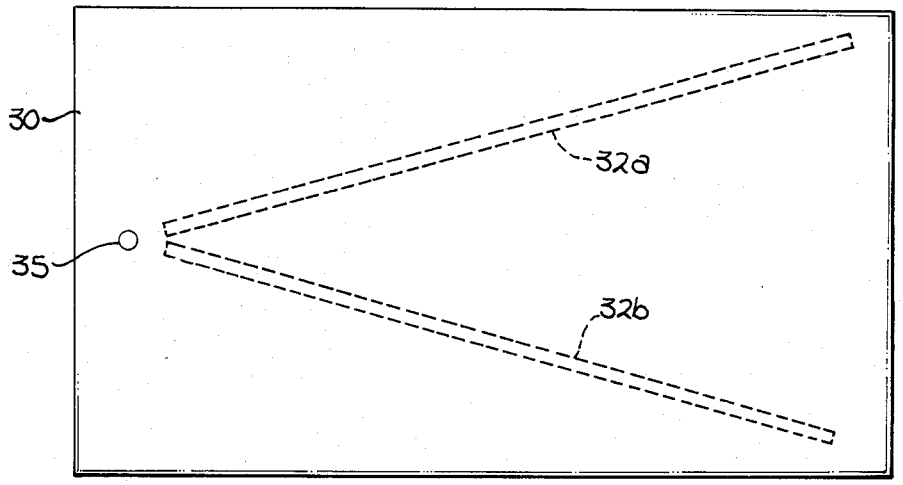
FIG. 1 is a top view of the present invention showing the liquid communicating means, here elongated, perforated pipes, shown in phantom lines.

As illustrated in the drawings, the invented waterbed system comprises a waterbed mattress formed of a watertight enclosure 30, the top surface of which is provided with a valve or drain port 35 with a removable stopper through which liquid is introduced into and removed from the mattress. This drain port is usually located toward one end of the mattress. Inside the mattress is a wave dampening filler material 41 such as foam or fiber products. More particularly, foam products such as expanded styrene plastic in bulk or in pieces, cellulosic sponge particles, polyurethane foam, foam rubber, vinyl foam or neoprene foam may be used as filler to dampen the wave motions of a filled waterbed mattress. Additionally, fiber products such as non-woven or very loosely woven expanded fiber product or combination of products which are bonded or fixed with a binder such as polyester fibers, bonded or unbonded with acrylic resin, either unwoven or very loosely woven, fiberglass fibers of the same type, or unbonded fiber such as pillow batting, may be used with the present invention to dampen wave motion.

Other wave dampening materials not particularly set forth herein may be used without departing from the scope of the present invention.

Figure 3:
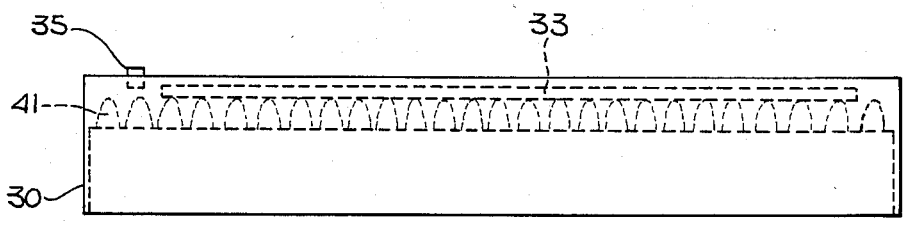
FIG. 3 is a cross sectional view of the present invention showing the positioning of the perforated pipes above the filler material.

Also provided in the invented waterbed mattress system is at least one liquid communicating means 33 as shown in FIG. 3 with at least one portion disposed near the drain port 35. In one embodiment as shown in FIG. 1, a plurality of tubes or pipes 32*a* and 32*b* with holes therein distributed about the circumference and along the length of each tube is disposed inside the mattress. It is not necessary for the liquid communicating means to be attached to the drain port to effectively drain a filled mattress.

When a suitable pump or siphon (not shown) is attached to the drain port and operated, water adjacent to the perforations leaks into the pipes and then moves quickly along the inner surface of the pipes toward the drain port area. Vacuum type effects adjacent the perforations, caused by movement of the center toward the drain port cause additional water to rise through the core and through the perforations. The draining means is then operated until the liquid contained in the mattress is emptied.

In one embodiment, these tubes may be made of a hard plastic material or other non-deformable material which can be inserted in the waterbed mattress above the wave dampening filler material when emptying of the mattress is to be performed, and removed therefrom at termination of the emptying procedure, so as to avoid discomfort of the user reclining on the mattress.

The most common type of pump is the Venturi type which can be operated on most household water spigots. The Venturi pump will drain a regular king size mattress in 40 to 50 minutes. However, a king size mattress containing foam or fiber material for wave dampening requires several hours to be drained and is generally still too heavy to be easily handled. Using the invented system with a Venturi type pump, a king size mattress can be drained down to a total weight of about 45 to 55 pounds in about one hour. Other sizes of waterbed mattresses can be likewise drained in a short time. Higher volume pumps will reduce the drain time correspondingly using the present invention. A Sears, Roebuck, Inc. pump, Model 26080, requires about 25 to 30 minutes to drain a king size waterbed mattress system of the present invention.

In one embodiment of the present invention, two six foot lengths of rigid vinyl pipe, 1/16th inch wall thickness and ½ inch outer diameter are perforated with a plurality of ⅛ holes. To drain the subject waterbed, the perforated pipe is inserted through the drain port on top of the foam core. The trailing end of the drain pipe is left in the area of the drain port 35 but having no fixed connection to the drain port. FIG. 1 shows the configuration of the pipes in this embodiment. The two pipes 32*a* and 32*b* are disposed in a "V" pattern fanning out from the drain port 35 towards the corners of the waterbed furthest away therefrom. A Venturi type pump is then coupled to the drain port and the liquid contained in the mattress drained thereby.

Figure 2:
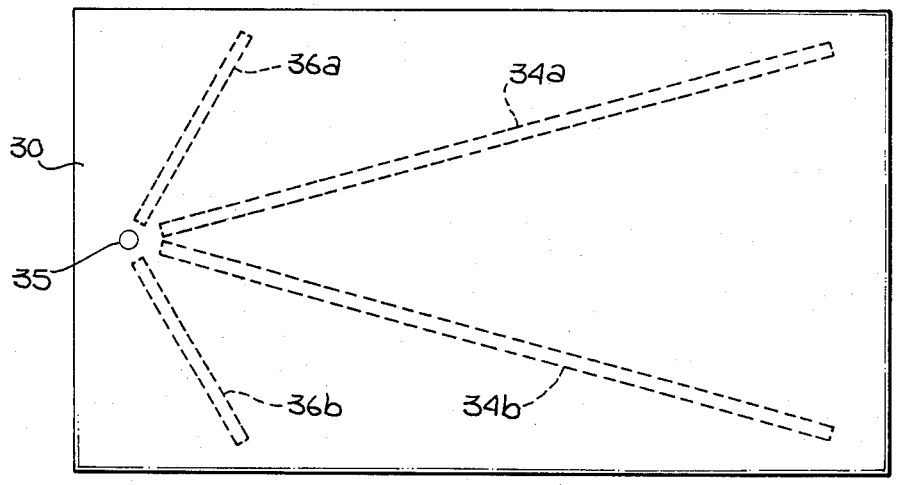
FIG. 2 is a top view of another embodiment of the present invention, again with the perforated tubes shown in phantom lines.

Referring now to FIG. 2, in another embodiment, four pipes perforated as in the first embodiment are disposed in the waterbed mattress. This embodiment is preferred when a high volume pump such as the Sears, Model 26080, is employed to remove liquid from the drain port. Two longer pipes 34*a* and 34*b* are disposed in the same configuration as described for FIG. 1. Two smaller sections of perforated pipes 36*a* and 36*b* are disposed at a greater angle to cover more volume of the waterbed mattress above the filler foam. Of course, other configurations of perforated pipe may be used without departing from the scope of the present invention.

In FIG. 3, the placement of the pipe 33 above the wave dampening filler material 41 is shown. In this instance the filler material is an open celled foam slab having an egg crate-shaped design. However as discussed above, the present invention can be used with any type of foam, fiber or similar filler.

Figure 4:
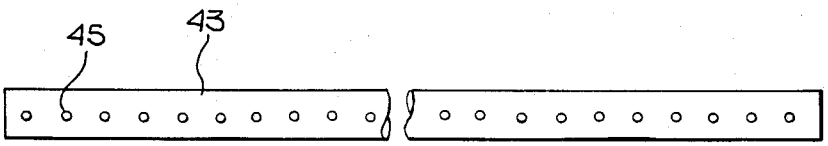
FIG. 4 is a cross sectional view of a perforated pipe used in the invention showing the preferred positioning of the holes therein.

FIG. 4 shows a preferred but not a necessary configuration of holes 45 distributed about the perforated pipe 43. In this embodiment, the holes 45 are disposed in pairs opposite each other. Each pair is offset 90 degrees about the circumference from the adjacent pairs of holes so that the tubes may be disposed in the mattress at any rotational angle. In this example, each pair of holes is approximately 6 inches from the next pair. It should be appreciated by one skilled in the art, however, that the number and distribution of holes can vary without departing from the scope of the invention.

It is apparent from the foregoing, that a new and improved waveless waterbed mattress system which rapidly empties has been provided. The measurements used in the present specification and the materials described herein, have been selected for descriptive purposes only in aiding in the explanation of the present invention, and are not meant to limit the scope of the present invention. It will be apparent to those familiar with the art that certain changes and modifications can be made without departing from the scope of the invention as defined by the claims.

What is claimed is:

1. A waterbed mattress system which dampens wave motion and drains rapidly, comprising:

a sealable liquid enclosure means with at least one drain port;

wave dampening filler disposed inside said enclosure means;

at least two perforated pipes disposed inside said enclosure means, said pipes disposed horizontally and adjacent said dampening filler, and each of said pipes having an open end disposed near said drain port and extending therefrom in a fanlike manner, whereby said pipes provide a relatively low resistance path for passing liquid contained in said enclosure means to said drain port, to be removed therefrom.

2. The waterbed mattress system defined in claim 1, wherein said wave dampening filler comprises a fiber product which forms a mesh like barrier to wave motion.

3. The waterbed mattresses system defined in claim 1, wherein said wave dampening filler comprises foam.

4. The waterbed mattress system defined in claim 1, wherein each of said perforated pipes comprise a plurality of holes about its circumference and along its length.

5. The waterbed mattress system defined in claim 1 wherein said pipe is removable from said enclosure means.

6. The waterbed mattress system defined in claim 1, comprising two perforated pipes.

7. The waterbed mattress system of claim 1, comprising two long pipes and two short pipes.

8. A method for rapidly draining liquid from a waterbed having wave dampening material disposed therein, comprising:

inserting at least two perforated pipes into a drain port of said mattress;

disposing said pipes in said mattress such that one end of said pipe is disposed near but spaced from said drain port and the other end of said pipe extends outward from said drain port in a fan like manner;

attaching draining means to said drain port;

operating said draining means to remove liquid contained in said mattress therefrom.

9. The method of claim 8, wherein two perforated pipes are inserted into the drain port of said mattress.

10. The method of claim 8, wherein said pipe comprises a plastic pipe having a pluralty of holes disposed about its circumference and along its length in a spaced-apart manner.

* * * * *